US007370635B2

(12) United States Patent
Snopko et al.

(10) Patent No.: US 7,370,635 B2
(45) Date of Patent: May 13, 2008

(54) SYSTEM AND METHOD FOR RESOLVING ELECTRICAL LEADS

(75) Inventors: Michael A. Snopko, Lincoln, IL (US); Jack A. Merchant, Peoria, IL (US); Scott F. Shafer, Morton, IL (US); Daniel R. Puckett, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 79 days.

(21) Appl. No.: 11/440,755

(22) Filed: May 25, 2006

(65) Prior Publication Data

US 2007/0169752 A1 Jul. 26, 2007

Related U.S. Application Data

(63) Continuation-in-part of application No. 11/337,248, filed on Jan. 20, 2006.

(51) Int. Cl.
*F02M 57/02* (2006.01)
*F02B 17/00* (2006.01)

(52) U.S. Cl. ..... 123/446; 123/198 D

(58) Field of Classification Search ..... 123/446, 123/447, 506, 494

See application file for complete search history.

(56) References Cited

U.S. PATENT DOCUMENTS 3,728,616 A 4/1973 Cheek et al.
3,986,106 A 10/1976 Shuck et al.
4,227,146 A 10/1980 Hodge
4,453,403 A * 6/1984 Bussey et al. ..... 73/119 A
4,616,617 A 10/1986 Geiger et al.
4,651,084 A 3/1987 Welsh et al.
4,714,998 A * 12/1987 Bussey et al. ..... 701/99
4,834,205 A * 5/1989 Mizuno et al. ..... 180/422
5,186,144 A 2/1993 Fukui
5,210,476 A 5/1993 Kazato
5,257,287 A 10/1993 Blumenthal et al.

(Continued)

FOREIGN PATENT DOCUMENTS

DE 199 55 617 A1 6/2001

(Continued)

OTHER PUBLICATIONS

PCT International Search Report, PCT/US2007/000530; International Filing Date: Jan. 9, 2007; Priority Date: Jan. 20, 2006; Applicant: Caterpillar Inc.

Office Action from U.S. Appl. No. 11/337,248, mailed Dec. 7, 2007, (6 pages).

*Primary Examiner*—Thomas Moulis
(74) *Attorney, Agent, or Firm*—Finnegan, Henderson, Farabow, Garrett & Dunner

(57) ABSTRACT

A control system for controlling a device, the device having at least two functional elements, each functional element being controlled by a control signal, is disclosed in the present disclosure. The control system may include detecting means operatively connected to the device and configured to monitor the operation of the device, and to generate a signal indicative of an operating condition of the device. The control system may also include a control module operatively connected to the at least two functional elements and the detecting means, and configured to switch the two control signals applied to the respective functional elements in response to the signal generated by the detecting means.

22 Claims, 6 Drawing Sheets

U.S. PATENT DOCUMENTS

| | | | | |
|---|---|---|---|---|
| 5,347,225 | A | 9/1994 | Graham | |
| 5,613,473 | A | 3/1997 | Angermaier | |
| 5,633,458 | A * | 5/1997 | Pauli et al. | 73/119 A |
| 5,970,784 | A | 10/1999 | Genin | |
| 6,253,145 | B1 | 6/2001 | Garrard et al. | |
| 6,323,656 | B2 | 11/2001 | Shoemaker | |
| 6,347,517 | B1 | 2/2002 | Sereni | |
| 6,367,316 | B1 * | 4/2002 | Eckerle et al. | 73/113 |
| 6,446,610 | B1 * | 9/2002 | Mazet | 123/497 |
| 6,457,465 | B2 | 10/2002 | Lee | |
| 6,471,540 | B1 | 10/2002 | Fernandez | |
| 6,484,573 | B2 * | 11/2002 | Bundock et al. | 73/119 A |
| 6,484,691 | B1 | 11/2002 | Schuster et al. | |
| 6,605,946 | B1 | 8/2003 | Yokoyama | |
| 6,830,033 | B2 | 12/2004 | Boerkel | |
| 6,932,057 | B2 | 8/2005 | Swanda et al. | |
| 6,988,031 | B2 | 1/2006 | McDonald et al. | |
| 6,990,958 | B2 * | 1/2006 | Asano et al. | 123/436 |
| 7,066,149 | B1 * | 6/2006 | Date et al. | 123/457 |
| RE39,212 | E | 8/2006 | Yokoyama | |
| 7,143,641 | B2 * | 12/2006 | Palazzolo et al. | 73/119 A |
| 2004/0154594 | A1 * | 8/2004 | Miyashita | 123/458 |
| 2005/0030934 | A1 | 2/2005 | Takahira et al. | |
| 2007/0070102 | A1 * | 3/2007 | Takata | 347/10 |
| 2007/0169756 | A1 * | 7/2007 | Potter et al. | 123/490 |

FOREIGN PATENT DOCUMENTS

| | | | |
|---|---|---|---|
| DE | 19955617 | A1 | 6/2001 |
| EP | 0 501 459 | A2 | 9/1992 |
| EP | 0 684 375 | A1 | 11/1995 |
| EP | 1450029 | * | 8/2004 |
| FR | 2 812 345 | | 2/2002 |

* cited by examiner

SYSTEM AND METHOD FOR RESOLVING ELECTRICAL LEADS

This application is a continuation-in-part of pending application Ser. No. 11/337,248 filed on Jan. 20, 2006, the specification of which is hereby incorporated by reference.

TECHNICAL FIELD

The present disclosure is directed to a system and method for resolving crossed electrical leads, and more particularly, to a control system and method for resolving crossed electrical leads on a pump.

BACKGROUND

Internal combustion engines for vehicles or work machines typically employ a fuel system that includes a fuel tank, a feed or priming pump, a high pressure pump, a high pressure common fuel rail, and a plurality of fuel injectors. The high pressure pump includes an inlet fluidly connected to the priming pump and fuel tank via a low pressure supply line, and an outlet fluidly connected to an inlet of the high pressure common fuel rail via a high pressure supply line. The common rail includes a plurality of outlets that are fluidly connected to fuel injectors via a plurality of high pressure supply lines. Fuel is drawn from the fuel tank by the feed pump and pumped toward the high pressure pump. The high pressure pump in turn pumps the fuel to the common fuel rail. Fuel is supplied to the fuel injectors from the high pressure fuel rail. In the case of a compression ignition engine, actuation of a fuel injector causes high pressure fuel to flow from the common fuel rail directly into the combustion chamber of the engine. This injected fuel is then mixed with air in the combustion chamber and combusted by the heat of compression during the compression stroke of the engine.

It is typical to use solenoid actuators at the inlet and/or outlet of the high pressure pumps to control the opening and closing of the inlet and/or outlet valves, and thereby control the fuel volume passing through the inlet and/or outlet valves to control the supply of high pressure fuel to the high pressure rail. For example, U.S. Pat. No. 6,446,610 to Mazet discloses a system for controlling the pressure in a high pressure common fuel rail, which includes a high pressure pump having a solenoid actuated valve at the inlet of the high pressure pump for controlling the volume of the fuel that passes through the pump inlet and into the pumping chamber. The opening and closing of the inlet valve is controlled to supply the pump chamber with a volume of fuel equal to the sum of the fuel mass to be injected into the combustion chambers of the engine. The delivered fuel volume at least partially compensates for a pressure difference between the measured fuel pressure within the common fuel rail and a target pressure.

In order for the high pressure pump to function properly, the current driving the solenoid actuator of the inlet valve of the high pressure pump must be applied in the correct sequence or phase. However, in industry, electrical leads used for supplying the driving current to the solenoid actuator may be mistakenly connected to the wrong actuator, and thus the current may be applied to an actuator in a reversed phase, which in turn, results in a high pressure pump having actuators that do not function properly. Conventionally, this situation is detected and corrected by adjusting the hardware components, for example, physically changing the electrical lead connections or manufacturing different leads and lead connectors between actuators. The traditional hardware measures to correct this crossing of the electrical leads add significant cost and complexity to the product.

The disclosed control system and method are directed to making improvements over prior systems.

SUMMARY OF THE INVENTION

In one aspect, the present disclosure is directed to a control system for controlling a device having first and second functional elements each controllable by a control signal. The control system may include a sensor arrangement operatively connected to the device and being configured to generate at least one signal indicative of an operating condition of the device. The system may further include a control module operatively connected to the first and second functional elements and the sensor arrangement. The control module may be operable to produce a first control signal having a first waveform and a second control signal having a second waveform. The control module may be operable, in a first mode, to transmit the first and second waveforms to the first and second functional elements, respectively, with a first predetermined offset. The control module may further be operable, in a second mode, to transmit the first and second waveforms to the first and second functional elements, respectively, with a second offset relatively longer than the first offset. The control module may also be operable to operate according to the first mode and thereafter to begin operating according to the second mode in response to at least one of: (i) a first at least one signal generated by the sensor arrangement and (ii) the control module operating according to the first mode for a predetermined length of time.

In another aspect, the present disclosure is directed to a method for controlling a hydraulic system including a hydraulic pump having first and second pumping chambers, each pumping chamber including at least one of an inlet valve and an outlet valve controllable by an actuator, each actuator being controllable by a respective control signal, and a hydraulic rail fluidly connected to the pump. The method may include operating the hydraulic system in a first mode in which a first control waveform is transmitted to a first actuator associated with the first pumping chamber and a second control waveform is transmitted to a second actuator associated with the second pumping chamber, the first and second transmissions occurring according to a first offset. The method may further include operating the hydraulic system in a second mode in which the first control waveform is transmitted to the first actuator associated with the first pumping chamber and the second control waveform is transmitted to the second actuator associated with the second pumping chamber, the first and second transmissions occurring according to a second offset longer than the first offset. The method may also include operating the hydraulic system according to the first mode and thereafter beginning to operate the hydraulic system according to the second mode in response to at least one of: (i) a hydraulic pressure characteristic in the rail and (ii) the control module operating according to the first mode for a predetermined length of time.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments or features of the invention and, together with the description, serve to explain the principles of the invention. In the drawings.

Although the drawings depict exemplary embodiments or features of the present invention, the drawings are not necessarily to scale, and certain features may be exaggerated in order to better illustrate and explain the present invention. The exemplifications set out herein illustrate exemplary embodiments or features of the invention and such exemplifications are not to be construed as limiting the scope of the invention in any manner.

DETAILED DESCRIPTION

In one embodiment, a control system for controlling a device (e.g., a pump), which may include at least two functional elements (e.g., actuators), each functional element being controlled by a control signal, is disclosed in the present disclosure. The control system may include detecting means (e.g., a sensor arrangement), operatively connected to the device and configured to monitor the operation of the device, and to generate one or more signals (e.g., pressure signals) indicative of an operational error when the device is not operating normally (e.g., when pressure falls below a satisfactory level). The control system may also include a control module operatively connected to the at least two functional elements and the detecting means, and configured to switch the two control signals (e.g., switch the timing or destination of the signals) applied to the respective functional elements in response to the one or more signals received from the detecting means.

Figure 1:
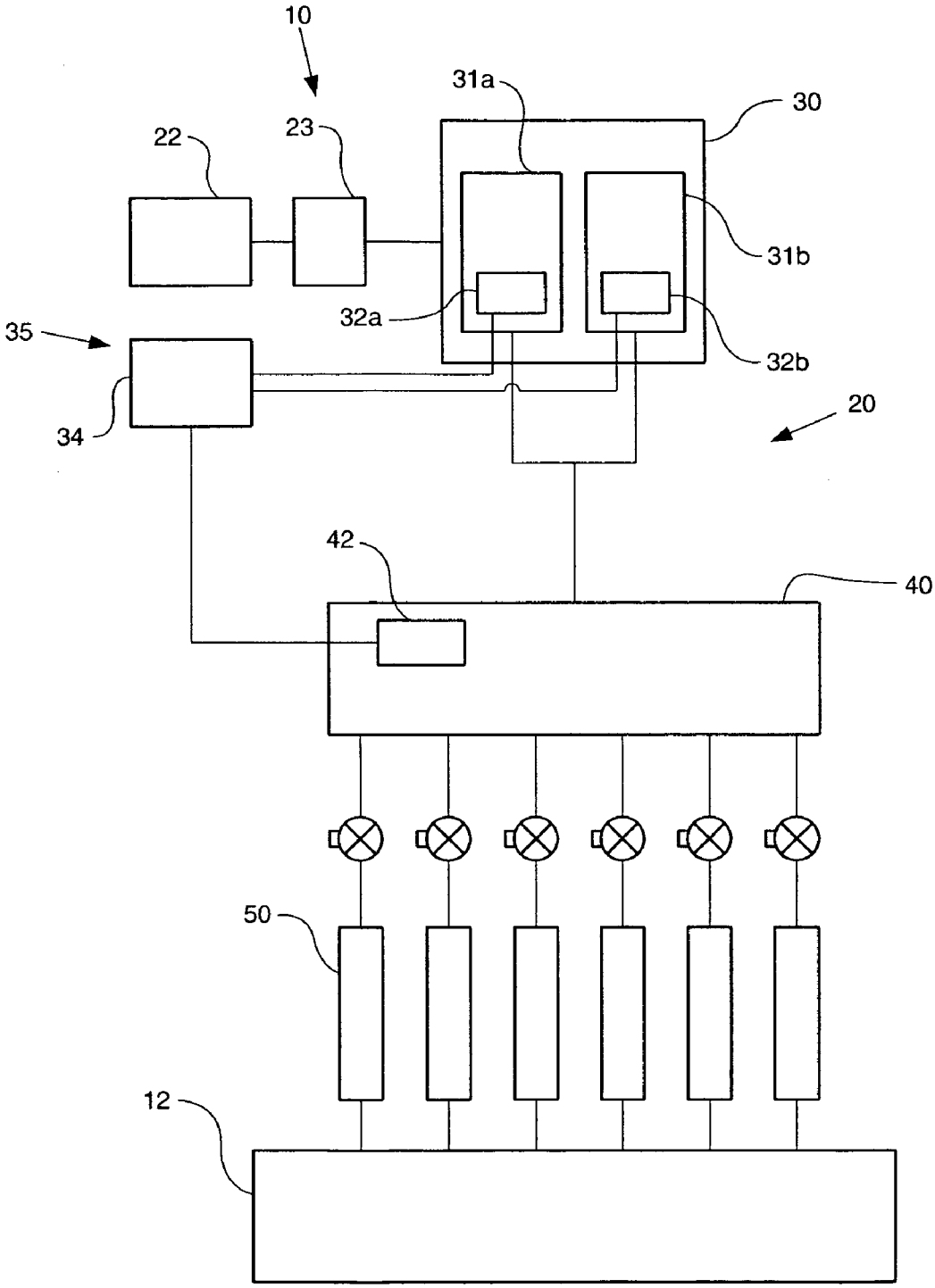
FIG. 1 is a schematic illustration of an exemplary engine and fuel system.

In one embodiment, the control system may be implemented in a hydraulic system, such as in an engine fuel system. FIG. 1 shows a schematic representation of an engine system 10 including an engine block 12 and a fuel system 20. Fuel system 20 may include a source of fuel 22 (which may be a fuel tank), a feed or priming fuel pump 23, a fuel pump 30 in fluid communication with the feed pump 23 and fuel tank 22, a common fuel rail 40 in fluid communication with pump 30, and a plurality of fuel injectors 50 in fluid communication with common rail 40. Fuel pump 30 may be any suitable pump, for example, a fixed displacement pump or a variable displacement pump. Pump 30 pumps fuel to common rail 40 under pressure, and the common rail 40 provides the pressurized fuel to fuel injectors 50. The fuel injectors 50 spray the highly pressurized fuel directly into the combustion chambers of engine block 12, where the fuel is mixed with air and burned. As will be understood, the engine system 10 of the present embodiment may be any type of internal combustion engine, such as a compression ignition or spark ignited internal combustion engine.

Pump 30 may include a plurality of pumping elements. As shown in FIG. 1, pump 30 may include two pumping elements 31*a* and 31*b*. Each pumping element 31*a* and 31*b* may reside in a respective pump cylinder to define a respective pumping chamber. Each pumping chamber may include an inlet valve and an outlet valve. The outlet valve may be a one-way check valve that allows fluid to flow in one direction from the pumping chamber to common rail 40 when the pressure of the fuel within the pumping chamber is sufficient to open the check valve. The inlet valves of the two pumping chambers may be respectively controlled by actuators 32*a* and 32*b*. Actuators 32*a* and 32*b* may be, for example, solenoid type actuators. The two pumping elements 31*a* and 31*b* may be driven by cams carried by a drive shaft that is driven in synchronism with the engine crankshaft. Movement of each pumping element 31, 31*b* may define a pumping element frequency. Thus, as engine speed is increased or decreased, pumping element frequency of the pumping elements 31*a*, 31*b* may increase or decrease accordingly.

Details of operation of one of the inlet valves of the pump 30 will now be discussed, with such details being equally applicable to the other of the inlet valves of the pump 30. The inlet valve of the pumping chamber may be normally biased open by a spring to allow fuel to flow from fuel tank 22 and feed pump 23 into the pumping chamber. Upon actuation of actuator 32*a*, the inlet valve is closed to block the supply of fuel to the pumping chamber. With the inlet valve closed, a specified amount of fuel is trapped within the pumping chamber. This specified amount of fuel in the pumping chamber is then pumped to the rail 40 during a pumping stroke of the pumping element 31*a*. During the pumping stroke of the pumping element 31*a*, the control signal to actuator 32*a* may terminate and the inlet valve may remain closed by the pressure of the fuel within the pumping chamber. The inlet valve may then reopen under the force of a biasing spring when the pumping element 31*a* begins to retract during a suction stroke and the pressure in the pumping chamber is reduced.

Figure 2:
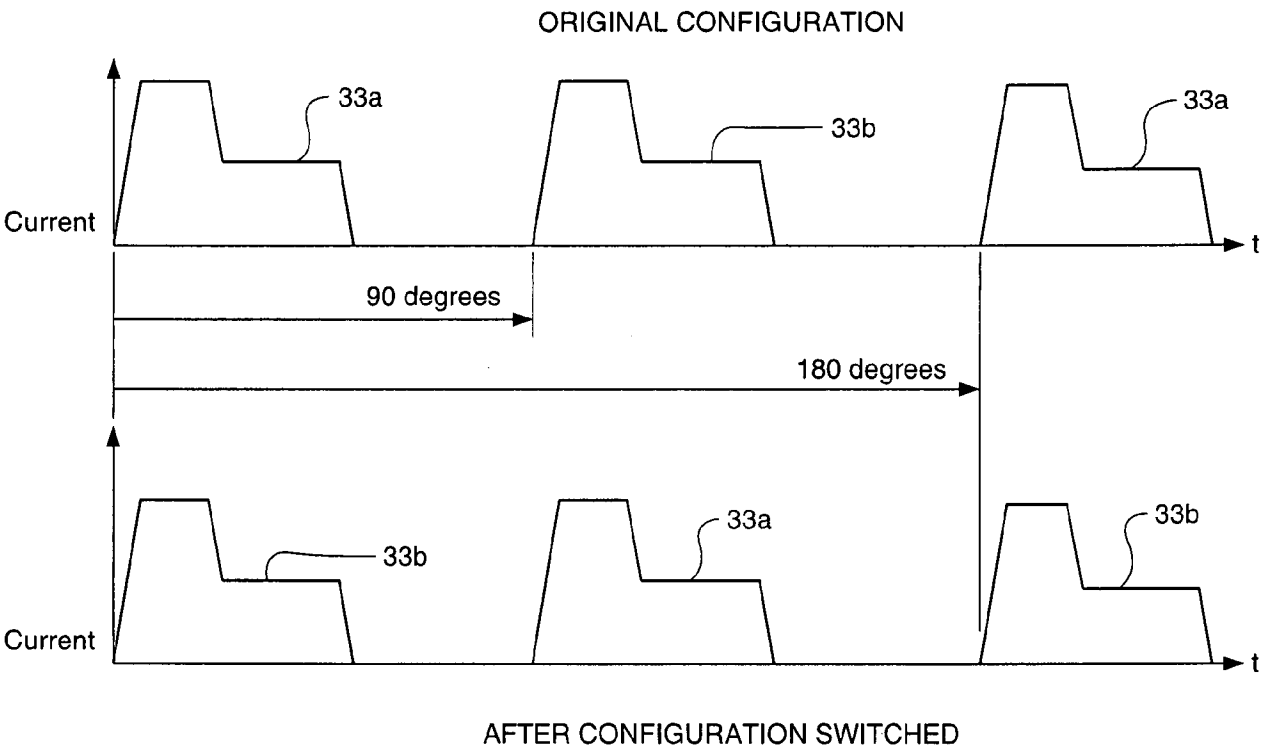
FIG. 2 is a graph of control signals for controlling actuators on a pump and showing the control signals in an original configuration and after the configuration is switched.

Fuel system 20 may further include a control system 35, which may include a control module 34 coupled to pump 30 and configured to generate two control signals 33*a* and 33*b* to respectively control the two actuators 32*a* and 32*b*. The two control signals 33*a* and 33*b* may be in the form of a periodic waveform as shown in FIG. 2 (waveform 33*a* and waveform 33*b*). Waveforms 33*a* and 33*b* may have substantially the same waveform shape and frequency, but may have a half-period phase difference. FIG. 2 shows the control signals 33*a* and 33*b* in the original configuration and after the configuration is switched (described in detail below). Each actuator 32*a* and 32*b* may be actuated (causing the respective inlet valve to close) at the time matching the desired amount of fuel to be delivered in the next pumping stroke. In one embodiment, the waveform sent to an actuator during a desired full pumping quantity may correlate to (e.g., may have substantially the same frequency as) the frequency of the reciprocal movement of the plunger of the pumping element (the pumping element frequency), such that each actuator may be actuated by the waveform every 180 degrees of the reciprocal movement of the plunger. In another embodiment having more cam lobes driving each of the pumping elements 31*a* and 31*b*, the pumping elements 31*a* and 31*b* may be actuated in sequence, alternating every 90 degrees in a 180 degree cam cycle, such that the inlet/outlet stroke of pumping element 31*a* occurs during the outlet/inlet stroke of pumping element 31*b*. Synchronized with the plungers, the two actuators 32*a* and 32*b* may be actuated in sequence with a phase difference of 90 degrees (half of the period).

The control system 35 of fuel system 20 may further include a sensor arrangement configured to generate at least one signal indicative of an operating condition (e.g., fuel pressure) of the device, such as sensor 42 coupled to common rail 40 for measuring the fuel pressure within common rail 40. Control module 34 may be connected to sensor 42 and may receive the fuel pressure signal from sensor 42. Control module 34 may be further configured to compare the measured fuel pressure with a predetermined/desired fuel pressure. The control module 34 may be configured to switch the two control signals 33*a* and 33*b* relative the two actuators 32*a* and 32*b* in response to the system not achieving, or not maintaining for a predetermined period of time, a predetermined operating state (e.g., a predetermined pressure in the rail). For example, if the measured fuel pressure is lower than the predetermined/desired pressure, control module 34 may switch the two control signals 33*a*, 33*b* relative the two actuators 32*a* and 32*b*. In other words, if the measured pressure is lower than a desired rail pressure, control module 34 may switch the signals transmitted to the actuators 32*a* and 32*b* so that control signal 33*a* is applied to actuator 32*b* and control signal 33*b* is applied to actuator 32*a*—alternatively, the timing of the control signals 33*a*, 33*b* may be switched such that control signal 33*a* still controls actuator 32*a*, but the control signal 33*a* is transmitted at the timing originally scheduled for transmission of control signal 33*b* to actuator 32*b*, and vice versa). Control module 34 may include a memory, for example, a non-volatile memory, to preserve the switched relationship between the control signals 33*a* and 33*b* and the actuators 32*a* and 32*b* for subsequent use, for example in response to at least one of: (i) the device achieving a predetermined operating state after the switch and (ii) the device maintaining a predetermined operating state for a predetermined period of time after the switch. For example, in one embodiment, the switched relationship may be preserved in a memory of the device if the fuel pressure of common rail 40 increases to or beyond a predetermined/desired value after control signals 33*a* and 33*b* are switched.

Figure 4A:
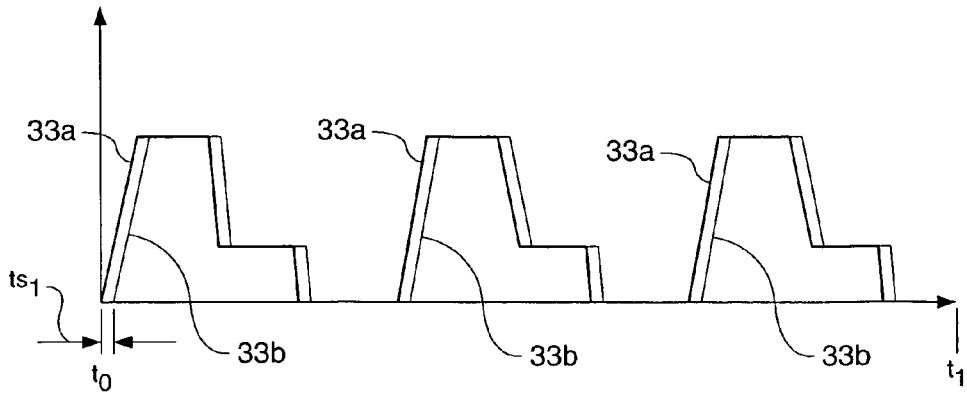
FIG. 4 is a graph of control signals for controlling actuators on a pump.
Figure 4B:
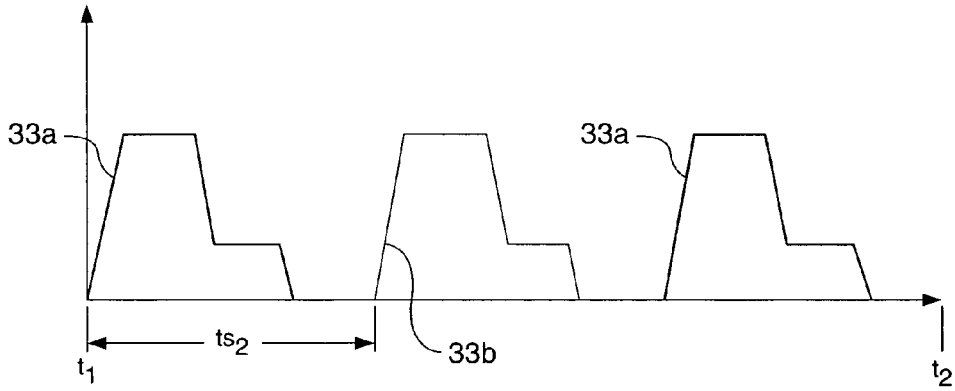
Figure 4C:
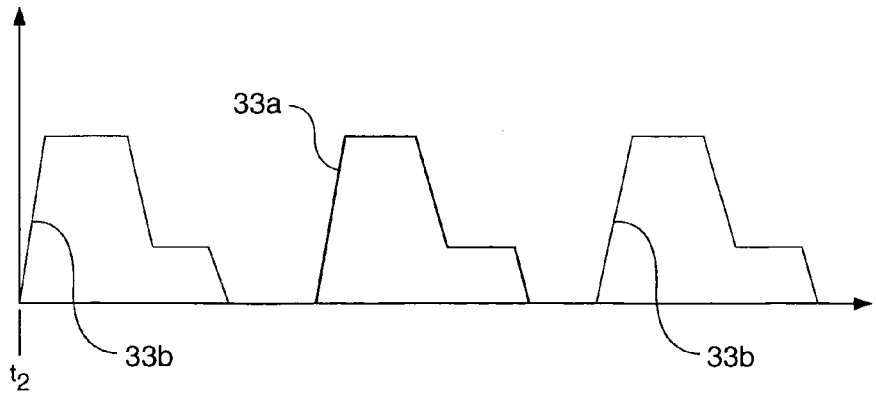

Additionally or alternatively, and with reference to FIGS. 4A, 4B, and 4C, the control module 34 may be operable in a first mode (FIG. 4A), a second mode (FIG. 4B), and a modified (signal-switched) second mode (FIG. 4C), as described below. The control module 34 may be operable, in a first mode (FIG. 4A), to transmit both the waveform of the control signal 33*a* and the waveform of the control signal 33*b* to the actuators 32*a* and 32*b*, respectively, with a first predetermined offset ts1. In a first embodiment, the control module 34 may be operable to transmit the respective waveforms at the same time (such that the predetermined offset ts1=0). In a further embodiment, the control module 34 may be operable to transmit the respective waveforms with a slight delay therebetween (ts1>0). For example, the waveform of the control signal 33*b* may be transmitted with a slight delay (e.g., ts1 could be set at 100 milliseconds or less) relative the transmission of the waveform of the control signal 33*a*. This delay in the transmission of the waveforms of the signals 33*a*, 33*b* may be appropriate to accommodate for electrical constraints of the control module 34. For example, in some embodiments, it may not be desirable (or possible in some cases) for the control module 34 to simultaneously transmit both waveforms of the control signals 33*a*, 33*b* to the actuators 32*a*, 32*b*. Thus a slight delay in transmission of the waveforms may accommodate for electrical constraints of a control module while having an effect on the actuators 32*a*, 32*b* and system substantially the same or similar to a simultaneous transmission of the waveforms to the actuators 32*a*, 32*b*. When operating in the first mode of operation, each waveform of each signal 33*a*, 33*b* may be transmitted at a frequency correlating to (e.g., may have substantially the same frequency as) twice the pumping element frequency.

The control module 34 may be further operable, in a second mode (FIG. 4B), to transmit both the waveform of the control signal 33*a* and the waveform of the control signal 33*b* to the actuators 32*a* and 32*b*, respectively, with a second offset ts2 relatively longer than the first offset ts1. In one embodiment, timing and transmission of the waveforms in the second mode occurs as described above with reference to FIG. 2. Thus, the offset ts2 between transmission of the waveforms in the second mode of operation may be substantially longer than the offset ts1 of the waveforms in the first mode—since, in one embodiment, the first offset ts1 (in the first mode of operation) may be set to cause substantially or nearly simultaneous actuation of the actuators 32*a*, 32*b*; while in the same embodiment, the second offset ts2 (in the second mode of operation) may be set to cause alternating actuation of the actuators 32*a*, 32*b* as described above with reference to FIG. 2.

INDUSTRIAL APPLICABILITY

The disclosed control to resolve crossed electrical leads of a pump may be implemented, for example, in a pump that has multiple pumping elements and electrically actuated pump valves. The disclosed control may also be implemented, for example, in a pump assembly that has multiple pumps and electrically actuated pump valves. Further, the disclosed control system may be implemented, for example, in a system that employs two solenoid actuators that are driven by electrical currents that may have substantially the same waveform shape and a half-period phase difference, for resolving crossed-electrical-lead problems. The disclosed system may be used, for example, to resolve a crossed-electrical-lead condition on solenoid actuators of pumps, where the electrical leads are used to transmit control signals to the actuators. It should be appreciated that other applications of the disclosed system may be possible, and that the disclosed embodiments are merely exemplary, with a true scope of the disclosure and its application being indicated by the claims. The operation of certain embodiments will now be explained.

Figure 3A:
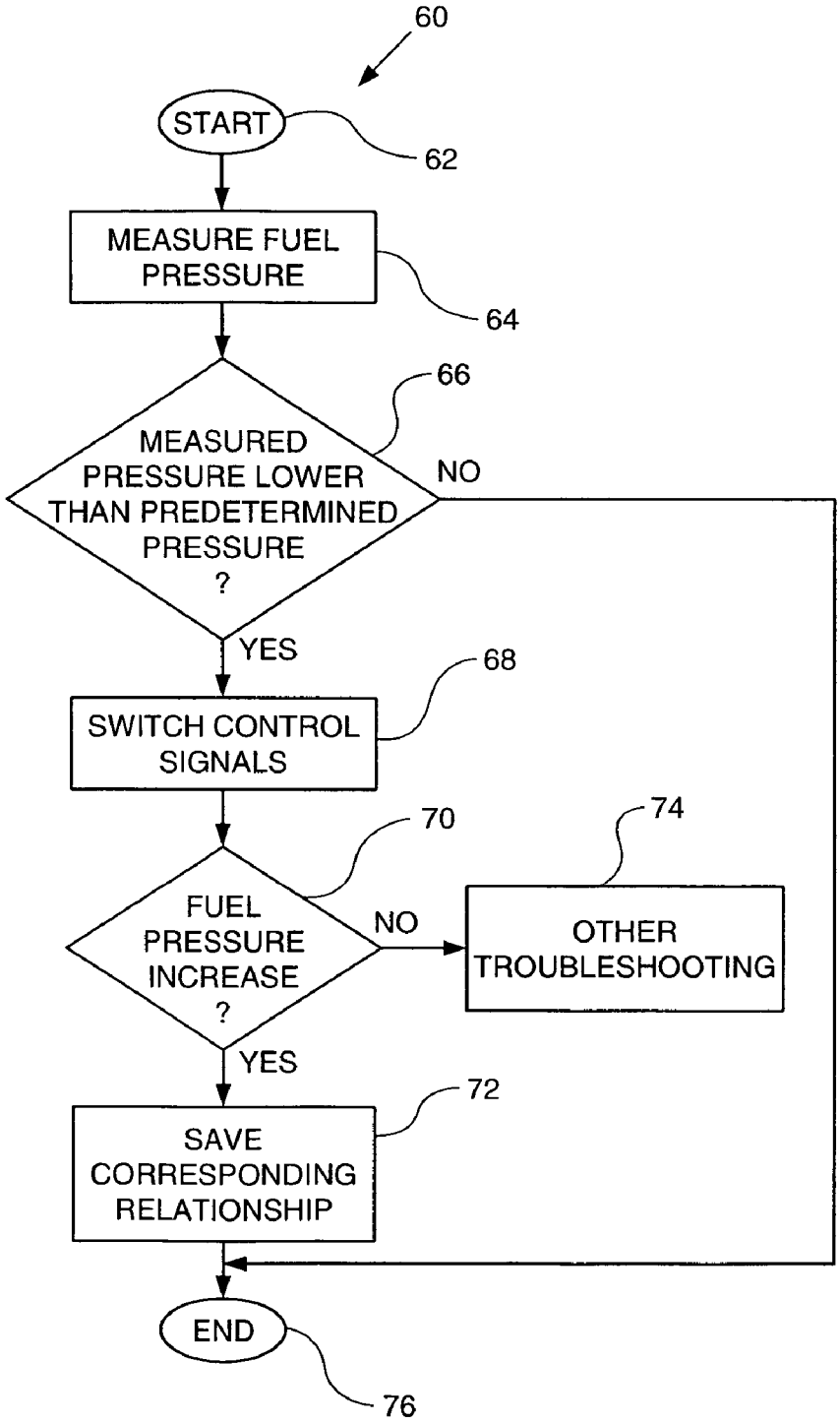
FIG. 3A is a flow chart illustrating an exemplary method for resolving crossed electrical leads on a pump.

FIG. 3A illustrates a process 60 for resolving possible crossed electrical leads of a fuel pump 30 in a fuel system 20. At step 62, for example upon engine startup, control module 34 may read from a memory saved data corresponding to the relationship between the control signals and the actuators, and may apply control signals 33*a* and 33*b* to actuators 32*a* and 32*b* based on the saved data. In normal operation, pumping elements 31*a* and 31*b* pump fuel from the fuel tank 22 and feed pump 23 into common rail 40. If pump 30 functions properly, and the process 60 is began upon engine startup, the fuel pressure in common rail 40 should start to increase, and should reach a predetermined/desired rail pressure value after a predetermined period of time (e.g., 10 seconds). The fuel pressure in common rail 40 is measured by pressure sensor 42 (step 64). The measured fuel pressure may be compared with the predetermined pressure value (e.g., 10 Mpa) at step 66. In one embodiment, this comparison may be performed after the predetermined period of time from the start of engine system 10. If the measured fuel pressure in common rail 40 is equal to or higher than the predetermined fuel pressure, then pump 30 may be considered to be functioning normally with the electrical leads correctly connected to actuators 32*a* and 32*b*. Thus, it may not be necessary to switch the control signals 33*a* and 33*b*, and the process may proceed to the end (step 76). If the measured fuel pressure in common rail 40 is lower than the predetermined pressure value, at step 68, control module 34 may switch control signals 33*a* and 33*b* (e.g., either the timing or destination of the signals) so that, for example, the control signals 33*a* and 33*b* that have been applied to respective actuators 32*a* and 32*b* are now applied to (e.g., transmitted to) actuator 32*b* and actuator 32*a*, respectively (or the timing of the control signals 33*a*, 33*b* may be switched such that control signal 33*a* still controls actuator 32*a*, but the control signal 33*a* is transmitted at the timing originally associated with transmission of control signal 33*b* to actuator 32*b*, and vice versa). At step 70, it may be determined whether the fuel pressure increases after the two control signals are switched. If the measured fuel pressure in the common rail 40 increases to or beyond a predetermined value, the corresponding relationship between the control signals and the actuators (e.g., the destination or timing of control signals 33*a* and 33*b* relative actuators 32*a* and 32*b*) may be saved in the memory of control module 34 for subsequent operations (step 72), and the process may proceed to the end (step 76). When the power is turned off and then turned back on again, control module 34 may use the control signal relationship saved in the memory to drive the actuators 32*a* and 32*b*. It should be appreciated that, if, after the control signals are switched, the measured fuel pressure in the common rail 40 is still lower than the predetermined fuel pressure, other troubleshooting procedures may be used (step 74).

Figure 3B:
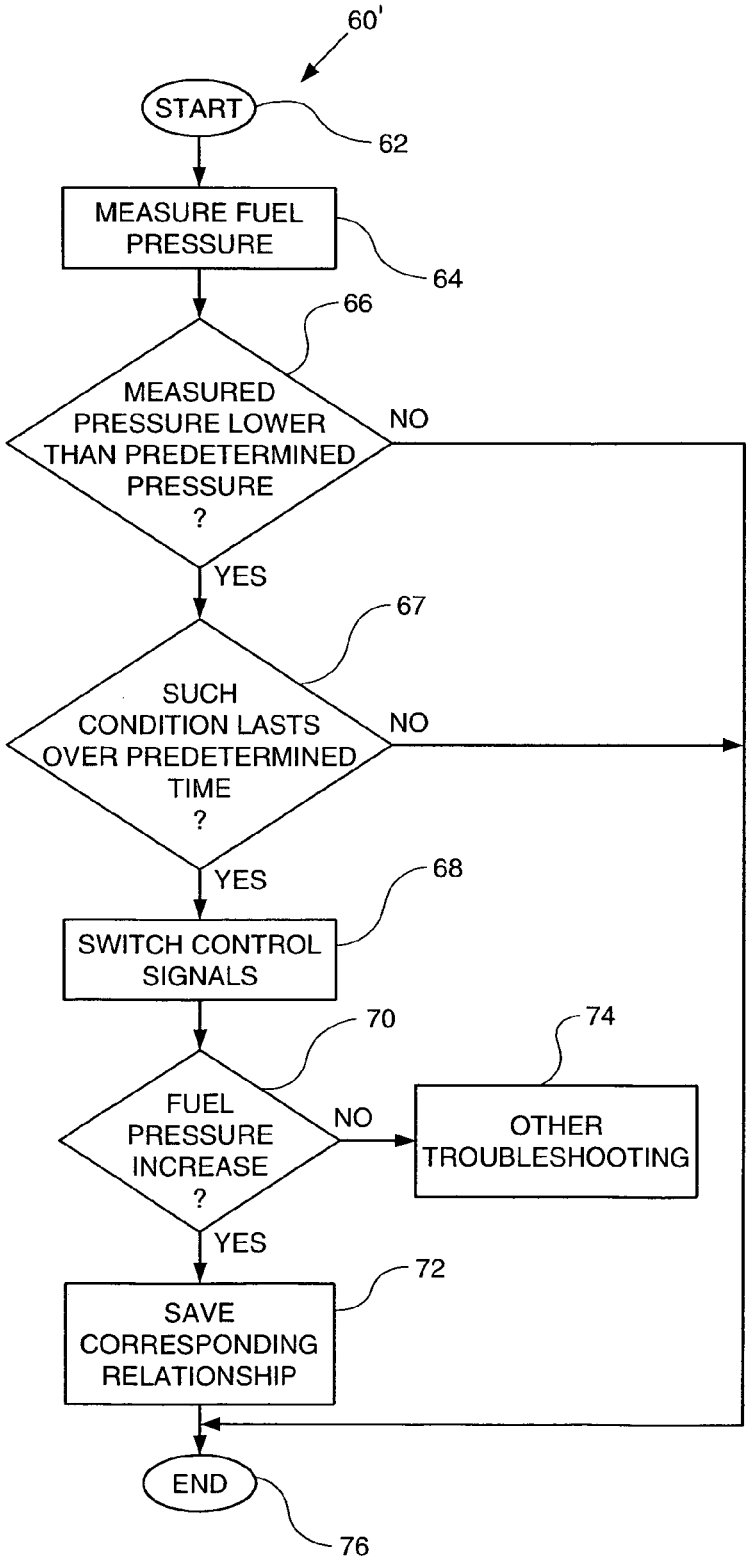
FIG. 3B is a flow chart illustrating another exemplary method for resolving crossed electrical leads on a pump.

FIG. 3B illustrates another embodiment of a process in accordance with the present disclosure, which is denoted by reference number 60', for resolving possible crossed electrical leads on a fuel pump in a fuel system. Process 60' is similar to process 60 shown in FIG. 3A, and elements which are similar or identical to elements in FIG. 3A have the same reference numerals for convenience. The difference between process 60' in FIG. 3B and process 60 in FIG. 3A is that, in process 60', upon determination that the measured fuel pressure is lower than the predetermined/desired fuel pressure (step 66), the fuel pressure in common rail 40 may be continuously measured to determine whether such condition (the fuel pressure being lower than the predetermined pressure) lasts for a predetermined time period, for example, one second (step 67). Control module 34 may be configured to measure the time period. If the condition lasts equal to or over the predetermined time period, control module 34 may switch the control signals for the actuators 32*a* and 32*b*. If the condition does not last equal to or over the predetermined time period and the fuel pressure in common rail 40 again becomes equal to or greater than the predetermined pressure value, there may be no need to switch the control signals for the actuators, and the process may proceed to the end (step 76).

Figure 5:
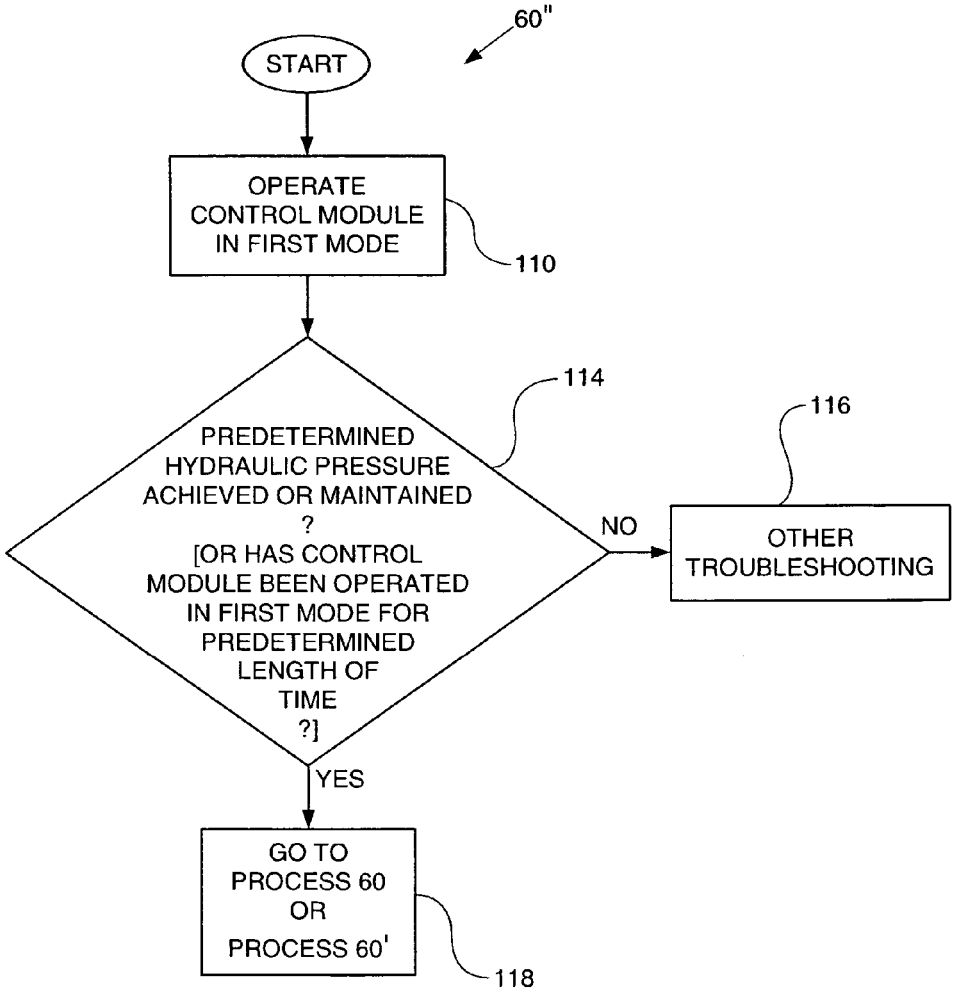
FIG. 5 is a flow chart illustrating another exemplary method for resolving crossed electrical leads on a pump.

FIG. 5 illustrates another embodiment of a process 60" in accordance with the present disclosure. In step 110, for example upon initial startup operations of an engine, the control module 34 may be operated according to the first mode of operation (FIG. 4A) as described above with reference to FIG. 4. In this mode of operation, the control module 34 may repeatedly transmit the waveforms of the control signals 33*a*, 33*b* to the actuators 32*a*, 32*b* at the same time or about the same time, with an offset ts1. During this mode of operation, both actuators 32*a*, 32*b* may be operated at or about substantially the same time, and the actuators may be operated at twice the frequency of operation of one of the pumping elements 31*a*, 31 *b*. Thus, in one embodiment being operated in the first mode, both actuators 32*a*, 32*b* may be "double actuated" to close both inlet valves of the pump 30 at least briefly during the initial phases of both the suction strokes and pumping strokes of the pumping elements 31*a*, 31*b*. If an inlet valve is actuated briefly (via a control waveform) during the initial phase of a suction stroke, the valve may close briefly in response to the waveform and then may re-open during the intake stroke under the force of a biasing spring to allow fuel to flow into the pumping chamber. If an inlet valve of the pump 30 is actuated briefly (via a control waveform) during the initial phase of a pumping stroke, however, the valve may remain closed during the pumping stroke due to the pressure of the fuel within the pumping chamber. Thus, "double actuation" of an actuator (at initial phases of both the suction and pumping strokes) still permits the actuator to take in fuel, build pressure in its respective pumping chamber, and expel pressurized fuel into the rail 40. Thus, when both actuators 32*a*, 32*b* are "double actuated" during an initial startup phase, pressure may be expected to increase in the fuel rail 40 as desired. It should be appreciated that this double actuation first mode of operation may ensure that pressure is accumulated in the rail 40 quickly during a startup operation of the engine.

Step 114 of FIG. 5 compares the operating state of the device with a predetermined operating state. If pressure in the rail 40, for example as indicated by the sensor arrangement 42, does not respond as desired—e.g., a predetermined pressure condition is not achieved in the rail and/or a predetermined pressure condition in the rail is not maintained for a predetermined period of time—then other troubleshooting operations may be appropriate to resolve the condition (proceed to step 116). However, if pressure in the rail 40 responds as desired, the "double actuation" first mode of operation may be terminated, and the second mode of operation (FIG. 4B) may be started (proceed to step 118, which leads to process 60 or process 60' of FIGS. 3A and 3B). For example, the "double actuation" first mode of operation may be terminated and the second mode of operation began if a predetermined operating state has been reached within the system. An example of a predetermined operating state being reached may include, for example, a predetermined hydraulic pressure condition or value being achieved in the rail and/or a predetermined hydraulic pressure condition or value being maintained in the rail for a predetermined period of time (e.g., 1 second). Alternatively, or additionally, the first mode of operation may be terminated, and the second mode of operation started, after the first mode of operation has been employed for a predetermined length of time (e.g., 10 seconds).

Upon switching to the second mode of operation, the control module may operate as described above with reference to FIG. 2 (e.g., by transmitting control waveforms 33*a*, 33*b* repeatedly to actuators 32*a*, 32*b* in alternating sequence) and as described in process 60 or process 60'. More specifically, upon switching to the second mode of operation, the applicable process 60 or 60' may begin at the respective block 64 of FIG. 3A or 3B. Thus, as described above with reference to processes 60 and 60', after initiating operation of the control module in the second mode, if the measured fuel pressure in the rail 40 drops to lower than a predetermined pressure value, for example as indicated by the sensor arrangement 42, the control module 34 may switch the control signals 33*a* and 33*b* (FIG. 4C). One benefit of employing process 60" prior to employing process 60 or process 60' is that pressure may be built quickly in the rail 40 by operating according to the first mode using a double actuation control method as described above. Then, if electrical leads for the pump 30 are crossed (e.g., the pump was mistakenly installed with electrical leads crossed during the most recent installation), when the control module begins to operate according to the second mode, an undesired pressure drop may be detected in the rail 40 and the control signals may quickly be switched. Thus, a quick engine startup operation may still occur and normal engine operation resumed without substantial interruption despite having a crossed-electrical-leads condition at startup.

Several advantages over the prior art may be associated with the disclosed control system and method. For example, the disclosed control system and method may use a software approach to resolve a hardware problem, potentially eliminating the need of certain hardware measures for resolving the crossed-electrical-lead condition. With the disclosed control system and method, the crossed-electrical-lead problem for solenoid actuators may be cost-effectively solved and an engine may be operated appropriately upon engine startup and after successful engine startup with minimal delay caused by a crossed-electrical-lead condition.

It will be apparent to those skilled in the art that various modifications and variations can be made to the disclosed control system and method. Other embodiments will be apparent to those skilled in the art from consideration of the specification and practice of the disclosed control system and method. It is intended that the specification and examples be considered as exemplary only, with a true scope being indicated by the following claims and their equivalents.

What is claimed is:

1. A control system for controlling at least a portion of a hydraulic system having first and second functional elements each controllable by a control signal, the control system comprising:

a sensor arrangement operatively connected to the hydraulic system and being configured to generate at least one signal indicative of an operating condition of the hydraulic system;

a control module operatively connected to the first and second functional elements and the sensor arrangement;

the control module being operable to produce a first control signal having a first waveform and a second control signal having a second waveform;

the control module being operable, in a first mode, to transmit the first and second waveforms to the first and second functional elements, respectively, with a first predetermined offset;

the control module being operable, in a second mode, to transmit the first and second waveforms to the first and second functional elements, respectively, with a second offset relatively longer than the first offset;

the control module being operable to operate according to the first mode and thereafter to begin operating according to the second mode in response to at least one of (i) a first at feast one signal generated by the sensor arrangement and (ii) the control module operating according to the first mode for a predetermined length of time.

2. The control system of claim 1, wherein the control module is operable to begin operating according to the second mode in response to the first at least one signal generated by the sensor arrangement being indicative that the hydraulic system has reached a predetermined operating state.

3. The control system of claim 2, wherein:

the predetermined operating state includes at least one of (i) the hydraulic system achieving a predetermined hydraulic pressure within the system and (ii) the hydraulic system maintaining a predetermined hydraulic pressure within the system for a predetermined period of time.

4. The control system of claim 1, wherein the first offset is about 100 milliseconds or less.

5. The control system of claim 4, wherein the first offset is equal to zero and the control module is operable, in the first mode, to transmit the first and second waveforms to the first and second functional elements, respectively, at the same time.

6. The control system of claim 1, wherein the control module is operable to switch the timing or destination of the waveforms applied to the respective functional elements in response to a second at least one signal generated by the sensor arrangement.

7. The control system of claim 6, wherein the control module is operable to switch the timing or destination of the waveforms applied to the respective functional elements in response to the second at least one signal generated by the sensor arrangement being indicative of an operational error with the hydraulic system.

8. The control system of claim 6, wherein the control module is operable to preserve the switched relationship between the waveforms and the functional elements in response to at least one of: (i) the hydraulic system achieving a predetermined operating state after the switch and (ii) the hydraulic system maintaining a predetermined operating state for a predetermined period of time after the switch.

9. The control system of claim 8, wherein:

the predetermined operating state includes the hydraulic system achieving or maintaining a predetermined hydraulic pressure within the system.

10. The control system of claim 1, wherein the first and second waveforms have substantially the same shape and frequency.

11. The control system of claim 1, wherein:

the hydraulic system includes a hydraulic pump having first and second pumping elements;

each of the first and second pumping elements is configured to move during operation of the hydraulic pump, movement of each pumping element defining a respective pumping element frequency;

the control module is operable, in the first mode, to transmit each of the first and second control signal waveforms at a frequency substantially correlating to twice at least one of the pumping element frequencies; and the control module is operable, in the second mode, to transmit each of the first and second control signal waveforms at a frequency substantially correlating to at least one of the pumping element frequencies.

12. A method for controlling at least a portion of a hydraulic system, the hydraulic system including a hydraulic pump having first and second pumping chambers, each pumping chamber including at least one of an inlet valve and an outlet valve controllable by an actuator, each actuator being controllable by a respective control signal, and a hydraulic rail fluidly connected to the pump, the method comprising:

operating the hydraulic system in a first mode in which a first control waveform is transmitted to a first actuator associated with the first pumping chamber and a second control waveform is transmitted to a second actuator associated with the second pumping chamber, the first and second transmissions occurring according to a first offset;

operating the hydraulic system in a second mode in which the first control waveform is transmitted to the first actuator associated with the first pumping chamber and the second control waveform is transmitted to the second actuator associated with the second pumping chamber, the first and second transmissions occurring according to a second offset longer than the first offset;

operating the hydraulic system according to the first mode and thereafter beginning to operate the hydraulic system according to the second mode in response to at least one of: (i) a hydraulic pressure characteristic in the rail and (ii) the control module operating according to the first mode for a predetermined length of time.

13. The method of claim 12, wherein the first offset is about 100 milliseconds or less.

14. The method of claim 13, wherein the step of operating the hydraulic system in a first mode includes transmitting the first and second waveforms to the first and second actuators, respectively, at the same time.

15. The method of claim 12, wherein the pressure characteristic includes at least one of (i) a predetermined pressure being achieved in the rail and (ii) a predetermined pressure being maintained for a predetermined period of time in the rail.

16. The method of claim 12, including, after operating the hydraulic system in the second mode, switching the destination or timing of the control waveforms applied to the respective actuators in response to a second hydraulic pressure characteristic in the rail.

17. The method of claim 16, wherein the second hydraulic pressure characteristic is indicative of an operational error with the system.

18. The method of claim 16, including preserving the switched relationship between the control waveforms and the actuators if, after the switch the hydraulic system at least one of: (i) achieves a predetermined hydraulic pressure characteristic and (ii) maintains a predetermined hydraulic pressure characteristic for a predetermined period of time.

19. The method of claim 16, wherein:

the step of operating the hydraulic system in a first mode includes transmitting each control waveform to its respective actuator at a frequency correlating to twice the frequency of operation of one of the pumping elements; and the step of operating the hydraulic system in a second mode includes transmitting each control waveform to its respective actuator at a frequency correlating to the frequency of operation of one of the pumping elements.

20. The method of claim 12, wherein:

the hydraulic system is a fuel system for an internal combustion engine; and the method includes operating the fuel system in the first mode during startup of the engine.

21. The method of claim 20, including operating the fuel system in the second mode after the engine has been successfully started.

22. The method of claim 20, including:

switching the destination or timing of the control waveforms applied to the respective actuators in response to a hydraulic pressure characteristic in the rail; and operating the fuel system according to the switched configuration after the engine has been successfully started.

* * * * *